US005551896A

United States Patent [19]

Hess et al.

[11] Patent Number: 5,551,896

[45] Date of Patent: Sep. 3, 1996

[54] MODULAR ELECTRICAL CONNECTOR SYSTEM

[75] Inventors: Anton J. Hess, Hagen; Wolfgang Holle, Iserlohn; Klaus Buhle, Schwerte, all of Germany

[73] Assignee: Leopold Kostal GmbH & Co. KG, Ludenscheid, Germany

[21] Appl. No.: 397,900

[22] Filed: Mar. 3, 1995

[30] Foreign Application Priority Data

Mar. 9, 1994 [DE] Germany ..... 44 07 796.3

[51] Int. Cl.[6] ..... H01R 13/502

[52] U.S. Cl. ..... 439/701; 439/717; 439/404

[58] Field of Search ..... 439/701, 708, 439/709, 717, 752, 712, 713, 714, 404, 398

[56] References Cited

U.S. PATENT DOCUMENTS 5,122,077 6/1992 Maejima et al. ..... 439/717
5,288,250 2/1994 Sumida ..... 439/701
5,288,251 2/1994 Sumida .
5,320,555 6/1994 Okabe ..... 439/701

FOREIGN PATENT DOCUMENTS 3326991 12/1987 Germany .
0360625 3/1990 United Kingdom .

*Primary Examiner*—Khiem Nguyen
*Assistant Examiner*—Yong Kim
*Attorney, Agent, or Firm*—Brooks & Kushman P.C.

[57] ABSTRACT

An electrical connector system which has several independent housing sections. Locking elements are formed onto a first housing section and extend through openings into the retaining chambers of an adjacent housing section. In order to create an electrical connector system which, starting from one housing section, is capable of being extended in various different ways through the connection of further housing sections, one of the independent housing sections is formed as a central housing. At least two other housing sections which are directly allocated to it are formed as satellite housings. The locking elements formed onto the central housing engage on the one hand in the retaining chambers of the first satellite housing and on the other hand in the retaining chambers of the second satellite housing.

18 Claims, 4 Drawing Sheets

MODULAR ELECTRICAL CONNECTOR SYSTEM

TECHNICAL FIELD

This invention relates to an electrical connector system for facilitating a separable electrical connection between the end portions of electrical cables or between the end portions of electrical cables and relevant electrical devices.

BACKGROUND ART

A prior electrical connector device has been made known in DE 33 26 991 C2. This electrical connector system consists of several individual housing parts which can be connected to one another in a row by clipping means. Each of the housing parts is supplied on the one hand with locking elements and on the other hand with openings. Each housing part exhibits a single retaining chamber. When the parts are connected in a row, the locking element of one housing part engages in the retaining chamber of a second housing part next to it and locks the electrical contact element which is in the retaining chamber. In such systems, however, only identically formed housing parts are connected to one another, which means that their scope remains relatively limited.

SUMMARY OF THE INVENTION

An aim of the present invention is to create a modular connector system that, starting from one housing part, can be extended in a large variety of ways by the connection of further housing parts which are different in form.

Accordingly, the present invention discloses a modular electrical connector system with at least two independent housing sections that can be clipped together in a row. Each housing section is provided with at least one retaining chamber to accommodate contact elements. At least one of the housing sections has locking elements which pass through suitable openings in the other housing section when the housing sections are joined together in order to lock contacts which are in the retaining chambers of the other housing section. One of the independent housing systems is formed as a central housing.

At least two other housing sections cooperate with the central housing in the form of satellite housings. The locking elements which are formed onto the central housing engage the retaining chambers of the first satellite housing and the retaining chambers of the second satellite housing.

The advantage of such a design is that housing parts with a single row of retaining chambers lying behind one another and also housing parts with a double row of such retaining chambers can be used as desirable without further measures being necessary.

Further advantageous versions of the invention are described in the subclaims. The invention is also shown in more detail in the drawings and described more closely with reference to a concrete example.

Figure 1:
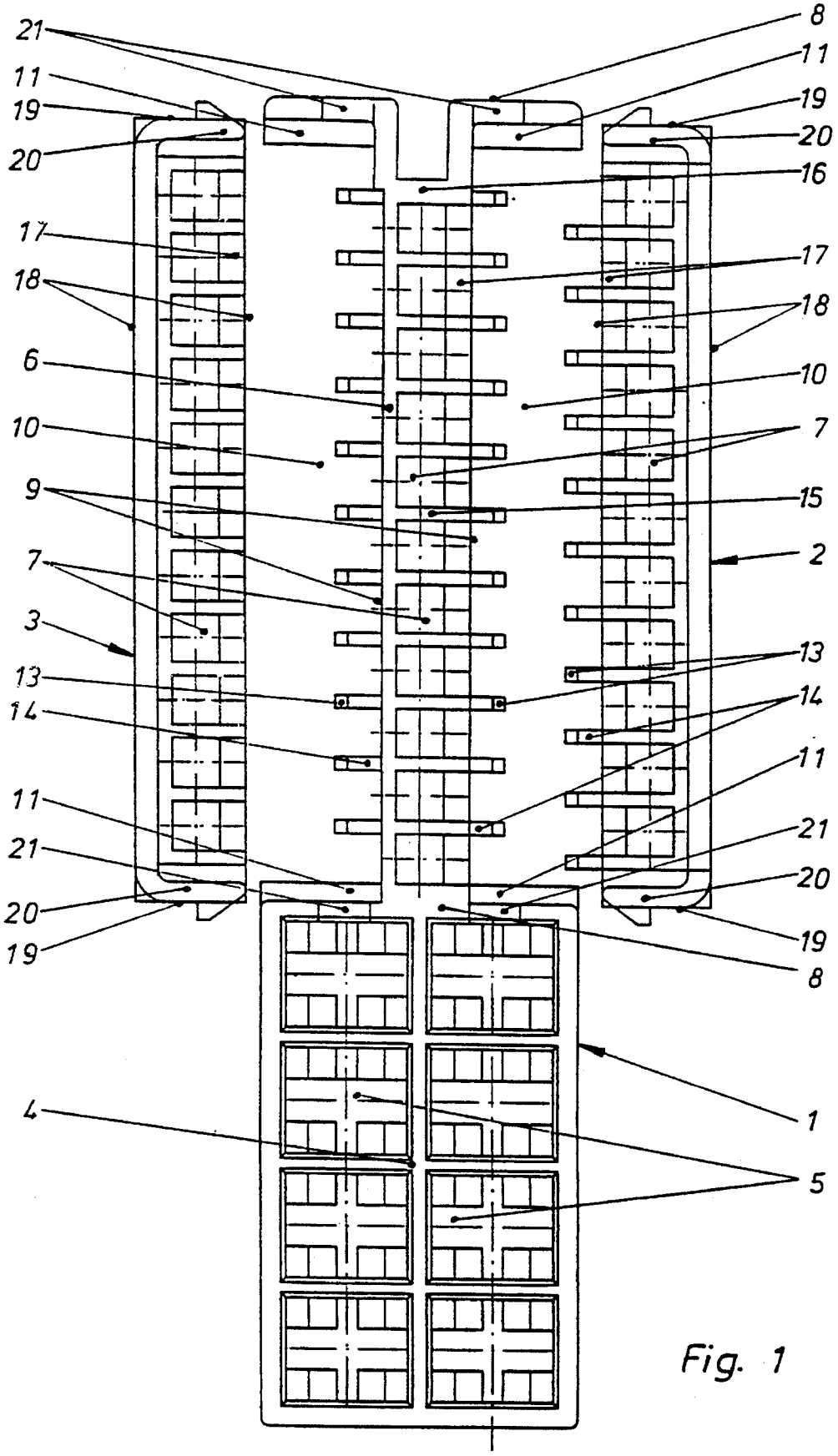
FIG. 1 is a top view of the central housing of an electrical connector system and two satellite housings ready to be connected.

Best Modes For Carrying Out The Invention

As can be seen from the drawing, a modular electrical connector system of the type shown here consists basically of a central housing 1, a satellite housing 2 which can be clipped onto the central housing 1 at one side, and a second satellite housing 3 which can be clipped onto the central housing 1 at the other side.

As shown particularly in FIG. 1, the central housing 1 and the satellite housings 2 and 3, which are all made of plastic material, have a primarily box-like form. Central housing 1 consists of a box-like first section 4, which exhibits two rows of four large retaining chambers 5, and a box-like second section 6 which has one row of eleven retaining chambers 7.

The width of the second section 6 corresponds approximately to one third of the width of the first section 4. Second section 6 is formed onto the middle of a short side 8 of first section 4, so that approximately one third of short side 8 remains free on each side of second section 6. At the free end of second section 6, short side 8, formed on as an integral part, corresponds to the width of first section 4. This second short side 8 extends outwards from the long sides of housing section 6 on each side by approximately one third of its length. On each side of section 6, therefore, there is an intermediate space 10 whose limits are formed by short sides 8. This intermediate space serves on one side to accommodate first satellite housing 2 and on the other side to accommodate second satellite housing 3.

Figure 3:
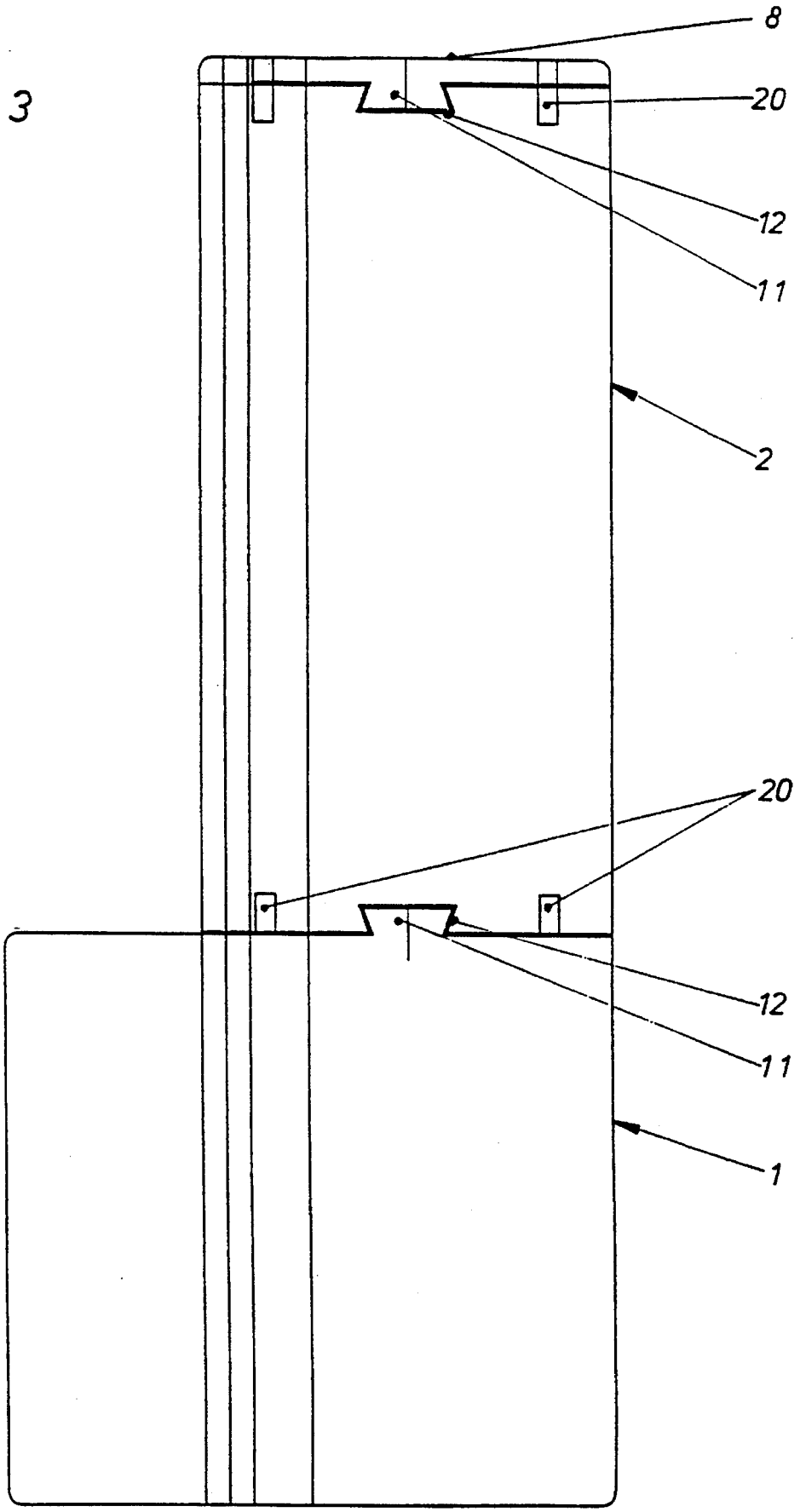
FIG. 3 is a side view of the electrical connector system shown in FIG. 2.

As can be seen particularly from FIG. 3, two swallow-tail tongue elements 11 are formed onto the opposite short sides 8 of central housing 1. When satellite housings 2 and 3 are attached to central housing 1, these tongue elements 11 engage with grooves 12 formed into both short sides 19 of the satellite housings. This means that the satellite housings are guided onto central housing 1 in a defined fashion, which eases the assembly process.

In addition, satellite housings 2 and 3 are secured in their final position at housing 1 by means of clips. To this end, two flexible clip arms 20 with tabs are formed onto both short sides 19 of each satellite housing.

When satellite housings 2 and 3 are assembled with central housing 1, the tabs of clip arms 20 engage with corresponding clip openings 21 in the short sides 8 of housing section 1, exerting elastic pressure. As can particularly be seen from FIG. 2, central housing 1 and satellite housings 2 and 3 together form a closed rectangular box-like element.

Eleven locking elements 13 and eleven blocking elements 14 are formed onto both long walls 9 of second central housing section 6, which extend outwards as tabs from both long walls of housing section 6. The number of locking elements 13 and blocking elements 14 corresponds to the number of retaining chambers 7 in satellite housings 2 and 3. Each locking element 13 and blocking element 14 is a continuation of dividing wall 15 which separates the retaining chambers from one another or a continuation of final wall 16.

Figure 4:
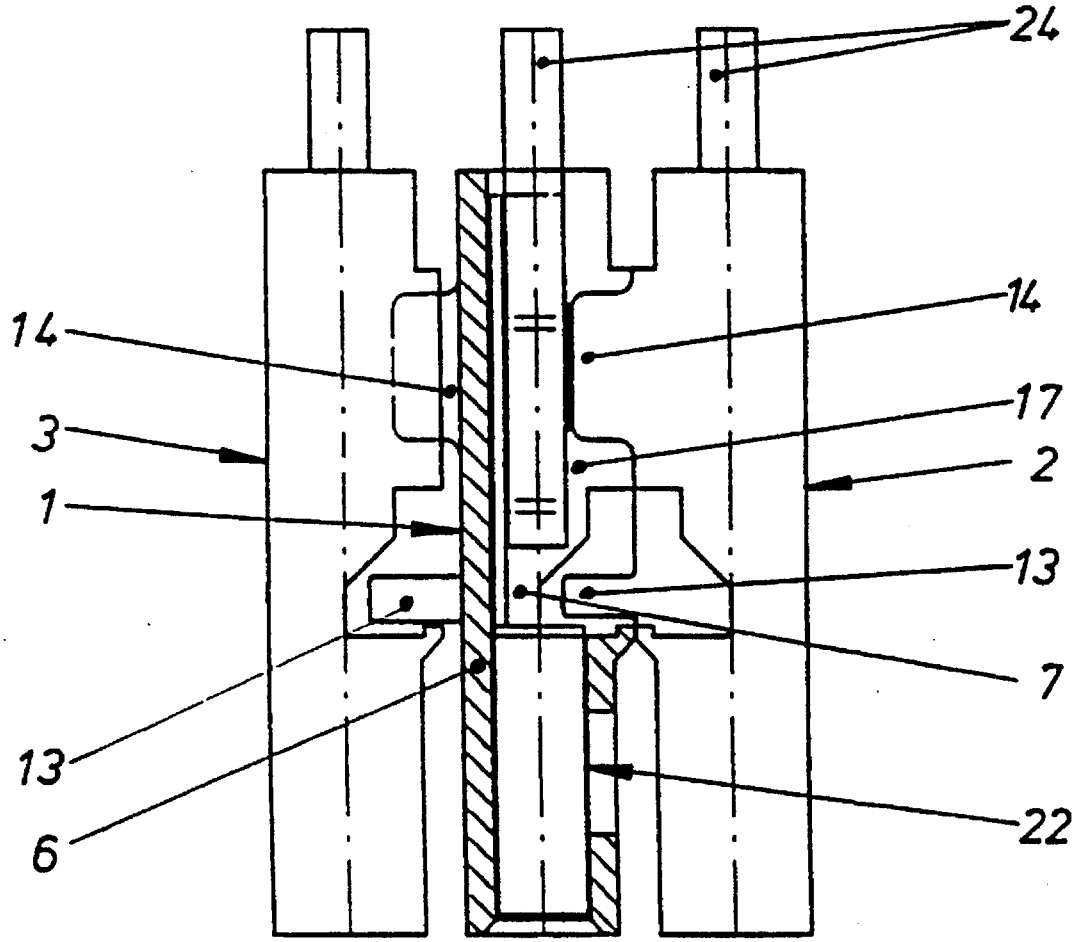
FIG. 4 is an enlarged cross section through a connector system at a point corresponding to the second section.

In addition, each retaining chamber 7 of central housing 1 has an opening 17 through which locking elements 13 and blocking elements 14 formed onto long side 18 of first satellite housing can pass into retaining chambers 7 of central housing 1. In this process, as particularly shown in FIG. 4, locking elements 13 come to rest against locking surfaces 23 formed onto contacts 22. At the same time, blocking elements 14 are forcefully pressed onto the electric cables 24, which are connected to contact elements 22. In this way, contact elements 22 are held securely in retaining chambers 7 and cables 24 are appropriately secured against pulling forces. Contact elements 22 are provided with a contact area which has insulation displacement elements to facilitate connection of the cables.

As shown particularly in FIG. 1, each of the two satellite housings 2,3 similarly is provided with eleven retaining chambers 7 which are arranged one behind the other. Each retaining chamber of satellite housings 2,3 is also provided with an opening 17, through which locking elements 13 and blocking elements 14 formed onto both long walls 9 of central housing 1 pass into the retaining chambers of satellite housings 2,3. In the same way here too, secure positioning of contact elements 22 in their retaining chambers 7 and strain relief for associated cables 24 is ensured.

Because central housing 1 is only supplied with one row of eleven retaining chambers 7 lying one behind the other, only long side 18 of first satellite housing 2 is provided with locking elements 13 and blocking elements 14. The two long sides 18 of satellite housings 2,3 which face away from the locking walls 9 of central housing 1 are neither provided with openings 17 nor locking elements 13 nor blocking elements 14. Because of this, the outside walls of the electrical connector system basically present a closed, smooth surface.

Figure 2:
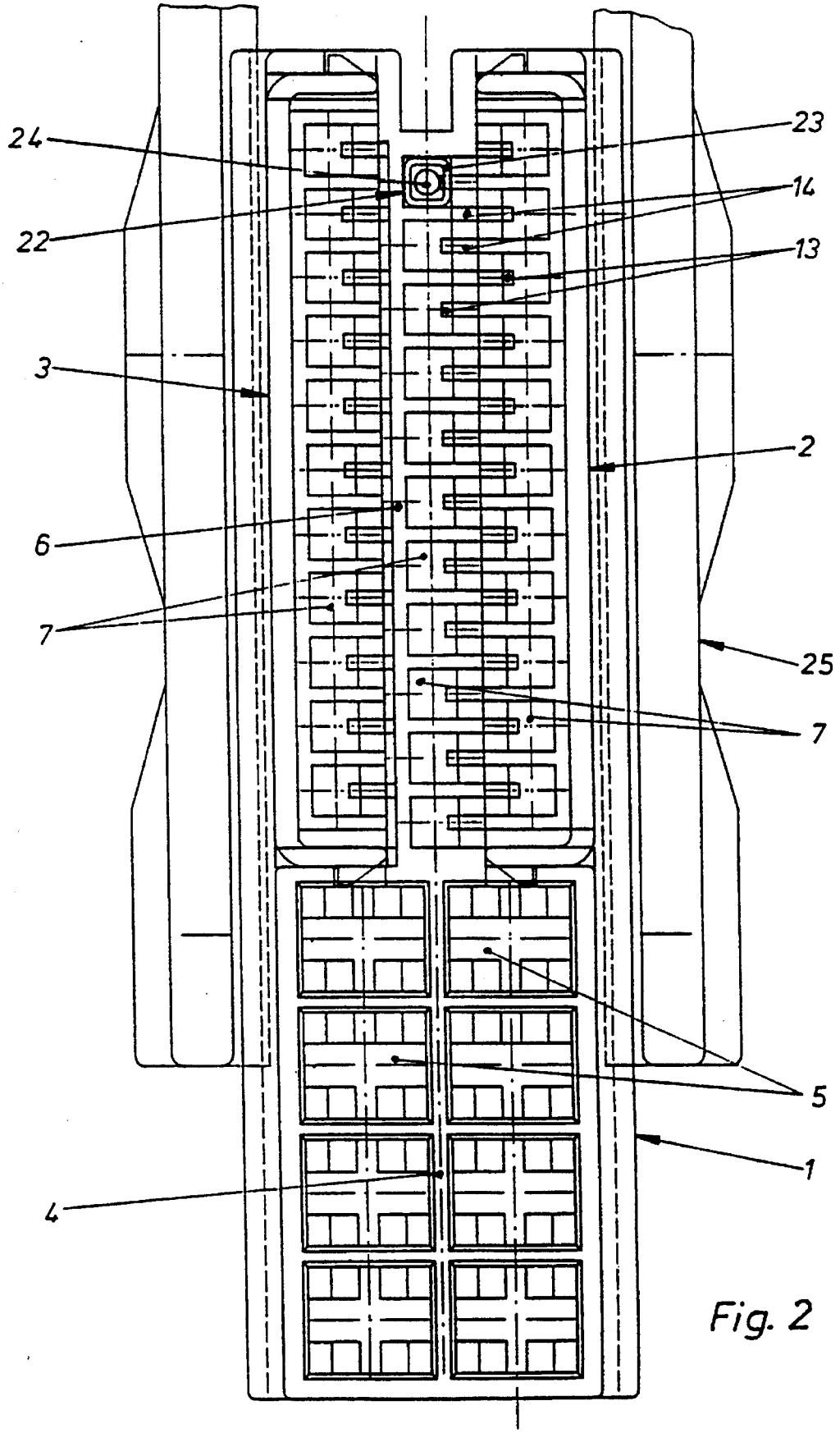
FIG. 2 is a top view of an electrical connector system, where the central housing is provided on both sides with a satellite housing, with an outer casing being provided for the whole.

As can particularly be seen from FIG. 2, the connector system with its central housing 1 and two satellite housings 2,3 is accommodated in outer casing 25 in such a way that it may be slid back and forth. This is achieved by an integrated tongue and groove system which is formed onto the components. Outer casing 25 serves to enable easy mating or separation of the complete connector system in collaboration with a complementary connector element in a manner which is well known in this field.

While the best mode for carrying out the invention has been described in detail, those familiar with the art to which this invention relates will recognize various alternative designs and embodiments for practicing the invention as defined by the following claims.

What is claimed is:

1. A modular electrical connector system, comprising:

at least two independent housing sections which can be clipped together in a row, and which are each provided with at least one retaining chamber for the accommodation of contact elements;

at least one of the independent housing sections having locking elements which pass through suitable openings in the other housing section when the housings sections are joined together in order to lock contacts which are in the retaining chambers of the other housing section;

one of the independent housing sections being formed as a central housing (1);

at least two other housing sections which cooperate with the central housing being in the form of satellite housings (2,3); and the locking elements (13) which are formed onto the central housing (1) engaging in the retaining chambers (7) of the first satellite housing (2) and the retaining chambers (7) of the second satellite housing (3).

2. The connector system according to claim 1 wherein:

at least the central housing (1) includes retaining chambers (5,7) of differing sizes.

3. The connector system according to claim 1, wherein:

both the central housing (1) and the satellite housings (2,3) are box-like in form, the locking elements which pass into retaining chambers (7) of the satellite housings (2,3) being formed onto two long walls (9) of the central housing (1) which are associated with the two satellite housings (2,3) at intervals which correspond to the retaining chambers (7) in the satellite housings (2,3).

4. The connector system according to claim 3 wherein:

the central housing (1) is provided with a single row of retaining chambers (7), the chambers lying one behind the other, openings (17) being provided in one of the long walls (9), each of the walls being provided with locking elements, only one of the two satellite housings (29) being provided with locking elements (13) on its long side which cooperates with the central housing (1).

5. The connector system according to claim 3 wherein:

the central housing (1) is provided with two rows of retaining chambers (7) lying one behind the other openings (17) being provided in both long walls (9) of the central housing (1), each of the walls being provided with locking elements (13) and in the long side (18) of both satellite housings which are associated with the central housing (1), the locking elements (13) being formed onto the long side (18) of each satellite housing (2,3) which is associated with the central housing (1).

6. The connector system according to claim 3, wherein:

at least one of the satellite housings (2,3) is provided with a single row of several retaining chambers (7) lying one behind the other, the long wall of the satellite housing which does not face the central housing (18) being provided with neither openings (17) nor with locking elements (13).

7. The connector system according to claim 3 wherein:

at least one of the two satellite housings (2,3) is provided with a single row of several retaining chambers (7) lying one behind the other and also openings (17) on its long side, which faces away from the central housing (1), so that at least one further satellite housing may be added.

8. The connector system according to claim 3 wherein:

at least one of the two satellite housings (2,3) is provided with two rows of several retaining chambers (7) lying one behind the other and is provided with openings (17) and locking elements (13) on both the long side (18) which face toward the central housing (1) and on the long side (18) which faces away from the central housing (1) so that at least one further satellite housing can be added.

9. The connector system according to claim 3 wherein:

the retaining chambers (7) of central housing (1) and satellite housings (2,3) are arranged alternately offset or staggered in relation to one another in such a way that a dividing wall (15) between the retaining chambers (7) is aligned at a point equivalent to an imaginary mid-line dividing the retaining chambers (17) of an adjacent housing section in half.

10. The connector system according to claim 2 wherein:

at least one of the satellite housings (2,3) includes retaining chambers of differing sizes.

11. The connector system according to claim 2 wherein:

short sides (19) of the satellite housings which cooperate with the central housing (1) and which are perpendicular to long sides (18) are provided with elastic clipping arms (20) which are formed in one piece and can be bent in a desired direction and which come to rest in clip openings (21) provided in the short walls (8) of the central housing (1) when the satellite housings (2,3) are attached to central housing (1).

12. The connector system according to claim 11, further comprising:

retaining arms having openings which are suitable for attachment of further satellite housings.

13. The connector system according to claim 12, wherein:

tongue and groove type guides (11,12) are provided on the short walls (8) of the central housing (1) and the short sides (19) of the satellite housings (2,3) which cooperate with each other.

14. The connector system according to claim 13, wherein:

tongue and groove type guides (11,12) are provided on the short sides (8) of satellite housings (2,3) and the short sides of further satellite housings.

15. The connector system according to claim 13 wherein:

the tongue and groove-type connections (11,12) are each in the form of a swallow-tail.

16. The connector system according to claim 14 wherein:

the tongue and groove-type connections (11,12) are each in the form of a swallow-tail.

17. The connector system according to claim 15 wherein:

blocking element (14) is allocated to each locking element which is formed onto the satellite housing (2,3) and the central housing (1), the locking element being allocated to a contact element (22) which is present in the relevant retaining chamber (7), the blocking element (14) penetrating into the same retaining chamber and coming to rest under pressure against an electrical cable (24) which is connected to the relevant contact element (22).

18. The connector system according to claim 16 wherein:

blocking element (14) is allocated to each locking element which is formed onto the satellite housing (2,3) and the central housing (1), the locking element being allocated to a contact element (22) which is present in the relevant retaining chamber (7), the blocking element (14) penetrating into the same retaining chamber and coming to rest under pressure against an electrical cable (24) which is connected to the relevant contact element (22).

* * * * *